US007811440B2

(12) United States Patent
Onodera et al.

(10) Patent No.: US 7,811,440 B2
(45) Date of Patent: Oct. 12, 2010

(54) PLATING APPARATUS AND PLATING METHOD

(75) Inventors: Kou Onodera, Tokyo (JP); Hiroshi Shindo, Tokyo (JP); Takashi Sakurai, Tokyo (JP)

(73) Assignee: TDK Corporation, Tokyo (JP)

( * ) Notice: Subject to any disclaimer, the term of this patent is extended or adjusted under 35 U.S.C. 154(b) by 1102 days.

(21) Appl. No.: 11/494,672

(22) Filed: Jul. 28, 2006

(65) Prior Publication Data

US 2009/0045069 A1 Feb. 19, 2009

(30) Foreign Application Priority Data

Jul. 28, 2005 (JP) ..... P2005-219137
Mar. 29, 2006 (JP) ..... P2006-091479

(51) Int. Cl.
*C25D 17/16* (2006.01)

(52) U.S. Cl. ..... 205/148; 204/237; 204/212

(58) Field of Classification Search ..... 205/148; 204/237

See application file for complete search history.

(56) References Cited

U.S. PATENT DOCUMENTS 5,851,368 A * 12/1998 Rumph ..... 204/213
6,228,230 B1 * 5/2001 Li et al. ..... 204/222
2001/0045360 A1 * 11/2001 Omasa ..... 205/108

FOREIGN PATENT DOCUMENTS

| | | |
|---|---|---|
| GB | 1 203 645 | 8/1970 |
| JP | A-53-150816 | 11/1978 |
| JP | A-05-320993 | 12/1993 |
| JP | A 09-137295 | 5/1997 |

OTHER PUBLICATIONS

English translation of Japanese Office Action issued in Application No. P2006-091457; mailed Oct. 20, 2009.

* cited by examiner

*Primary Examiner*—Harry D Wilkins, III
*Assistant Examiner*—Bryan D. Ripa
(74) *Attorney, Agent, or Firm*—Oliff & Berridge, PLC

(57) ABSTRACT

A plating apparatus performs a plating process while placing a work in a pod disposed in a plating bath storing a plating solution. The pod has a pair of meshes that allow the plating solution to pass but substantially inhibit the work from passing. The plating apparatus is provided with a solution flowing mechanism for flowing the plating solution out of the pod through one of the pair of meshes.

7 Claims, 5 Drawing Sheets

PLATING APPARATUS AND PLATING METHOD

BACKGROUND OF THE INVENTION

1. Field of the Invention

The present invention relates to a plating apparatus and plating method.

2. Related Background Art

An example of the plating apparatus is a barrel plating apparatus (e.g., reference is made to. Patent Document 1 below). This barrel plating apparatus is provided with a rotary drum housing mechanism, an electricity medium and a plating solution, a center rod disposed in the center of the drum, and a cathode attached to this center rod.

[Patent Document 1] Japanese Patent Application Laid-Open No. 9-137295

SUMMARY OF THE INVENTION

The conventional barrel plating apparatus tends to increase the number of incompletely plated entities with decrease in the size of entities to be plated. The inner wall of the drum is provided with unevenness for effectively agitating the entities in some cases. In such cases, the entities may be caught by this unevenness. It is also likely that the inner wall of the rotating drum pushes up the entities to exert an excessive external force on the entities.

An object of the present invention is therefore to provide a plating apparatus and plating method capable of effectively reducing defects in entities to be plated.

In order to achieve the above object, the Inventors conducted more detailed investigation on the behavior of entities in the barrel. As a result, the Inventors discovered that bubbles remained around the entities in the barrel and the remaining bubbles still remained even during a plating process to raise the possibility of occurrence of imperfect plating. The present invention has been accomplished on the basis of this expertise.

A plating apparatus according to the present invention is a plating apparatus for performing a plating process while placing an entity to be plated, in a pod disposed in a plating bath storing a plating solution, wherein the pod has at least a pair of sieve members which allow the plating solution to pass but substantially inhibit the entity from passing, the plating apparatus comprising solution flowing mechanism for flowing the plating solution out of the pod through one of the pair of sieve members.

Since the plating apparatus according to the present invention is arranged to flow the plating solution through one of the pair of sieve members which the pod disposed in the plating bath has, the plating solution flows into the pod through the other sieve member in accordance with the outflow. Therefore, a liquid flow occurs in the pod and the liquid flow lifts the entity up and removes bubbles existing near the entity. Since the entity is lifted up by the liquid flow, the plating apparatus is able to agitate the solution without exerting an excessive external force on the entity.

In the plating apparatus according to the present invention, preferably, an anode is disposed in the plating bath and outside the pod and a cathode is disposed in the pod. Since the cathode is disposed in the pod while the anode is disposed outside the pod, an electric current is allowed to flow while the entity in the pod is kept in contact with the cathode only.

The plating apparatus according to the present invention preferably further comprises a rotating mechanism for rotating the pod around an axis which is along a direction of outflow of the plating solution. Since the pod is rotated around its axis along the direction of outflow of the plating solution, a vortex flow occurs around the axis to lift the entity up.

In the plating apparatus according to the present invention, preferably, the solution flowing mechanism flows the plating solution into the pod through the sieve member through which the plating solution has passed in outflow thereof Since the plating solution is flowed into the pod through the sieve member through which the plating solution has passed in outflow thereof, the liquid flow can be directed in the opposite direction, whereby the entity lifted up can be moved down.

In the plating apparatus according to the present invention, preferably, the pair of sieve members are arranged opposite to each other in a vertical direction. Since the pair of sieve members are arranged opposite to each other in the vertical direction, the liquid flow occurring in the pod can be directed along the vertical direction, and when the entity lifted up is moved down, the entity can be collected on the lower sieve member.

A plating method according to the present invention is a plating method of performing a plating process while placing an entity to be plated, in a pod disposed in a plating bath storing a plating solution, the plating method comprising a solution flowing step of flowing the plating solution out of the pod, and a plating step of letting an electric current pass through the plating solution to plate the entity.

Since the plating method according to the present invention is arranged to flow the plating solution out of the pod disposed in the plating bath, the plating solution flows into the pod in accordance with the outflow. Therefore, a liquid flow occurs in the pod and the liquid flow removes bubbles existing near the entity. Since the entity is lifted up by the liquid flow, this plating method can implement agitation without exerting an excessive external force on the entity.

The plating method according to the present invention preferably further comprises an inflow step of letting the plating solution flow into the pod through the sieve member through which the plating solution has passed in outflow thereof, after the solution flowing step. Since the plating solution is flowed into the pod through the sieve member through which the plating solution has passed in outflow thereof, the liquid flow can be directed in the opposite direction, whereby the entity lifted up can be moved down.

In the plating method according to the present invention, preferably, the plating step is carried out in accordance with the inflow step. Since the plating is performed in accordance with the descending motion of the entity lifted up, the plating can be performed while bringing the entity in contact with another where there are a plurality of entities.

According to the present invention, the liquid flow occurs in the pod and the liquid flow removes bubbles existing near the entity. Since the entity is lifted up by the liquid flow, the agitation can be performed without exerting an excessive external force on the entity. Accordingly, the present invention provides the plating apparatus capable of effectively reducing defects in the entity.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The expertise of the present invention can be readily understood in view of the following detailed description with reference to the accompanying drawings presented by way of illustration only. Subsequently, an embodiment of the present invention will be described with reference to the accompanying drawings. The same portions will be denoted by the same reference symbols as much as possible, without redundant description.

Figure 1:
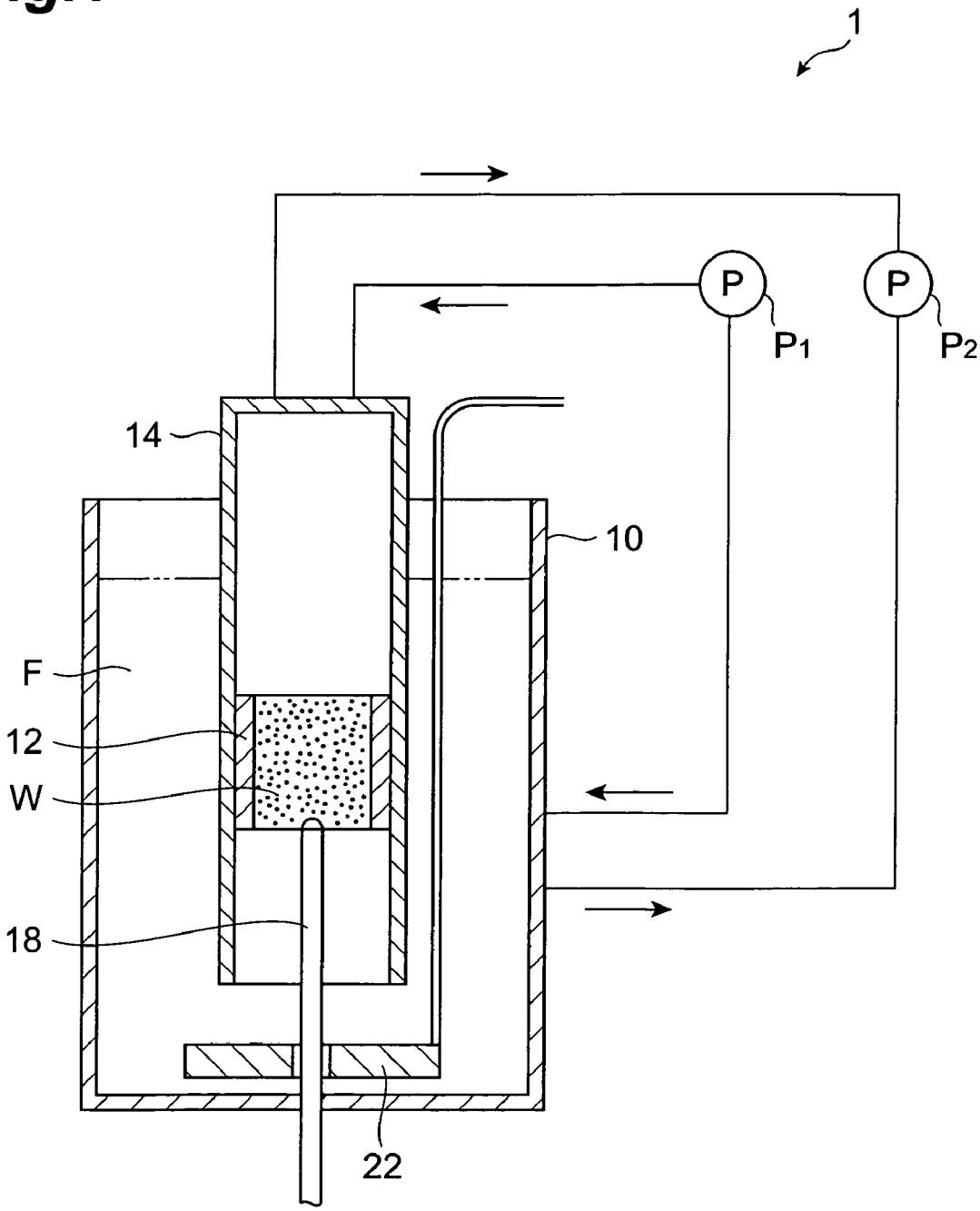
FIG. 1 is a drawing for explaining a configuration of a plating apparatus as an embodiment of the present invention.

A plating apparatus as an embodiment of the present invention will be described. FIG. 1 is a sectional view of the plating apparatus 1 as an embodiment of the present invention. As shown in FIG. 1, the plating apparatus 1 is provided with a plating bath 10 storing a plating solution F, a pod 12 disposed in the plating bath 10, and a cylinder 14 inside which the pod 12 is disposed. An anode 22 is located inside the plating bath 10 and outside the pod 12, and a cathode 18 is located inside the pod 12. The plating bath 10 and the cylinder 14 are connected by two pipelines, and the pipelines are provided with a first pump P1 and with a second pump P2, respectively.

The plating bath 10 is a bottomed receptacle made of an insulating material (e.g., resin) in a rectangular parallelepiped shape, and having an open top. The interior of the plating bath 10 is filled with the plating solution F. The rodlike cathode 18 is located so as to penetrate the bottom of the plating bath 10.

The anode 22 is located around the region where the cathode 18 extends from the bottom of the plating bath 10. The anode 22 is a ring-shaped electrode and is provided so as to surround the cathode 18.

The cathode 18 is arranged to be rotatable around the axis thereof. A voltage is applied to the cathode 18 and anode 22 by an unrepresented DC voltage applying mechanism (DC power supply and rectifier). The cathode 18 functions as a negative electrode and the anode 22 as a positive electrode.

The cylinder 14 is put through the opening of the plating bath 10 in the plating solution F. The cylinder 14 has such a sufficient length that even if one end thereof is put in the plating solution F up to contact with the bottom part of the plating bath 10, the other end projects out of the plating solution F. The end of the cylinder 14 outside the plating bath 10 is closed and the interior of the cylinder 14 is filled with the plating solution F.

The pipeline provided with the first pump P1 can circulate the plating solution F from the plating bath 10 via the first pump P1 to the cylinder 14. Therefore, while the first pump P1 is active, the plating solution F flows from top to bottom in FIG. 1 inside the cylinder 14.

The pipeline provided with the second pump P2 can circulate the plating solution F from the cylinder 14 via the second pump P2 to the plating bath 10. Therefore, while the second pump P2 is active, the plating solution F flows from bottom to top in FIG. 1 inside the cylinder 14.

Figure 2:
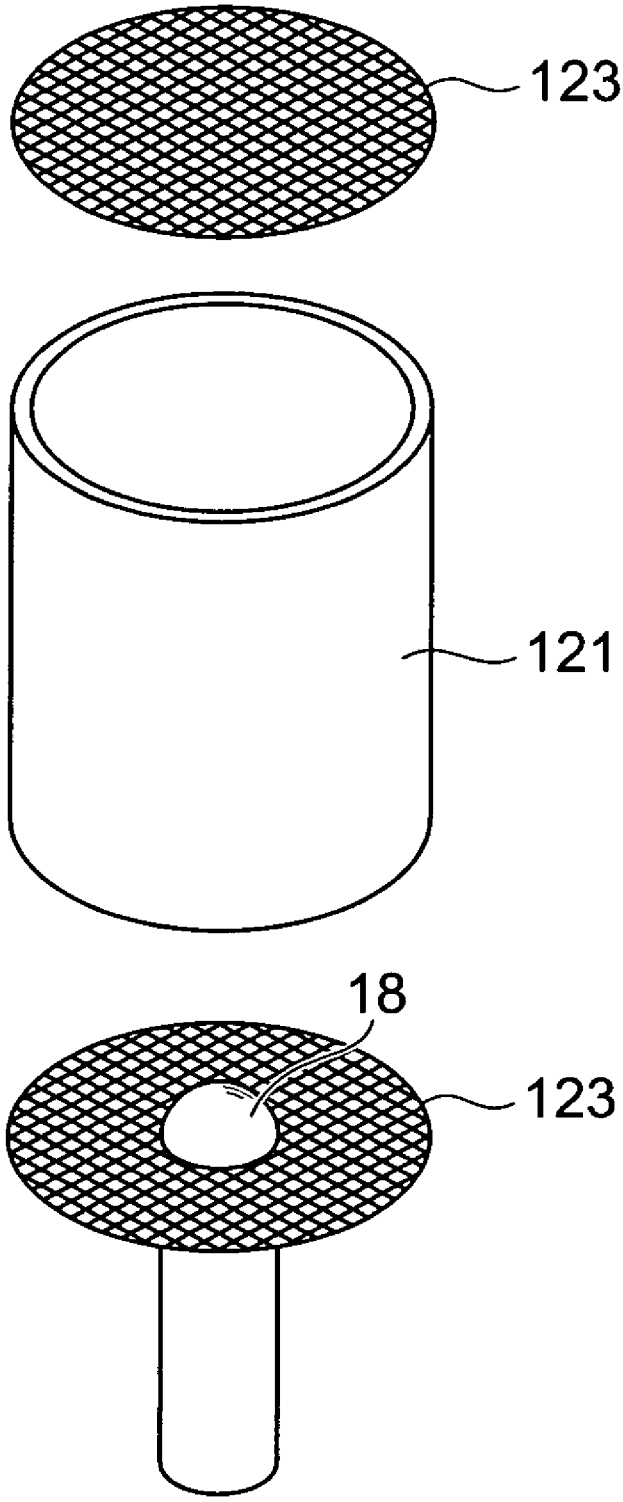
FIG. 2 is an exploded configuration view of a pod shown in FIG. 1.

The cylinder 14 is arranged to house the pod 12. The pod 12 will be described with reference to FIG. 2. FIG. 2 is an exploded perspective view of the pod 12. The pod 12 is composed of a cylinder 121, and a pair of meshes 123 (sieve members). The cylinder 121 is of a circular cylinder shape. Namely, the cylinder 121 is a main body in which a cavity space is formed so as to extend from one end to the other end. One of the meshes 123 is located at one end of the cylinder 121 and the other mesh 123 is located at the other end of the cylinder 121. The cathode 18 is attached to one mesh 123. The mesh 123 with the cathode 18 attached thereto is arranged so that when the mesh 123 is mounted on the cylinder 121, the cathode 18 projects inside the cylinder 121.

The meshes 123 are netlike members and are configured to substantially inhibit a work W (entity to be plated) disposed in the pod 12, from passing. For example, a mesh of the meshes 123 is made smaller than each work W, or a plurality of netlike members are laminated so as to inhibit each work W from passing. Namely, the meshes 123 are configured to regulate passage of each work W. The meshes 123 may be replaced by sheetlike members or platelike members with fine holes made by laser processing or the like so as to fulfill much the same function. The works W are multilayer electronic components such as chip capacitors, chip varistors, chip inductors, and chip beads.

The cathode 18 is fixed to one mesh 123. Therefore, as the cathode 18 is rotated about its axis by an unrepresented motor or the like (rotating mechanism), the pod 12 also rotates about its axis in accordance with the rotation of the cathode 18. A vortex flow occurs according to this rotation in the plating solution F inside the pod 12.

In the present embodiment the first pump P1 and the second pump P2 are alternately activated, whereby the plating solution F can be alternately flowed up and down in the cylinder 14 and in the pod 12. In this case, the plating solution F flows out of the pod 12 through one of the meshes 123 and flows into the pod 12 through the other mesh 123, and therefore the pipeline provided with the first pump P1 and the pipeline provided with the second pump P2 function as a solution flowing mechanism.

Figure 3:
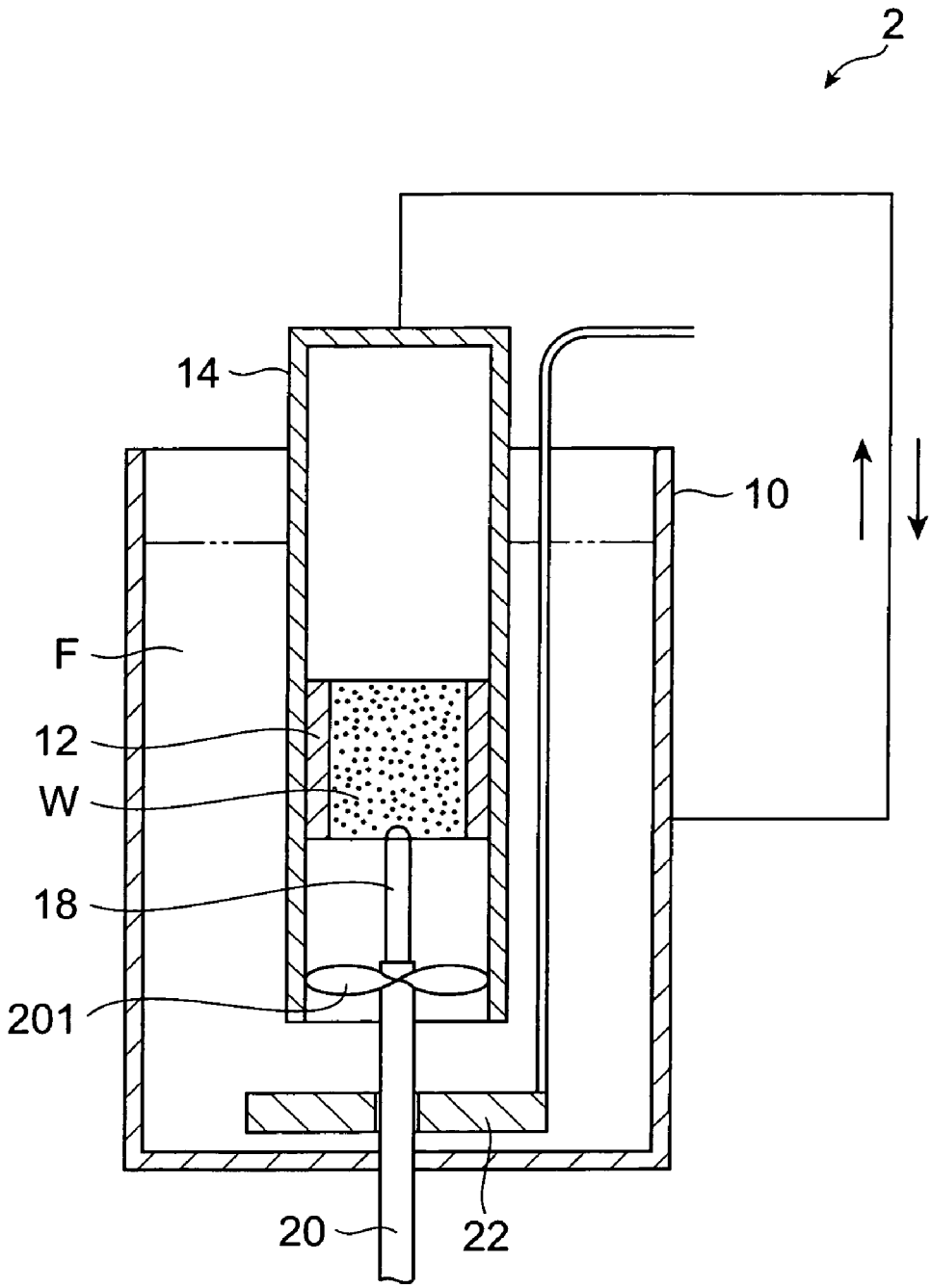
FIG. 3 is a drawing showing a modification example of the plating apparatus shown in FIG. 1.

The solution flowing mechanism can also be selected from a variety of mechanisms other than the combination of the first pump P1 with the second pump P2 shown in FIG. 1. Modification examples of the present embodiment in terms of modification of the solution flowing mechanism will be described with reference to FIGS. 3 and 4. FIG. 3 is a drawing showing the first modification example, and FIG. 4 a drawing showing the second modification example.

The plating apparatus 2 according to the first modification example shown in FIG. 3 is provided with a plating bath 10 storing a plating solution F, a pod 12 disposed in the plating bath 10, and a cylinder 14 inside of which the pod 12 is set. An anode 22 is located inside the plating bath 10 and outside the pod 12, and a cathode 18 is located inside the pod 12. The plating bath 10 and cylinder 14 are connected by one pipeline.

The plating bath 10, pod 12, cylinder 14, and anode 22 are the same as those described above. A shaft 20 is provided so as to penetrate the bottom of the plating bath 10, and the cathode 18 is located at the tip of this shaft 20.

The shaft 20 is provided with a screw 201. The screw 201 is provided so as to be located inside the cylinder 14. The screw 201 rotates according to rotation of shaft 20, so that the plating solution F inside the cylinder 14 can be flowed up and down in FIG. 3 in accordance with its rotating direction. The interior of the cylinder 14 is filled with the plating solution F, and the cylinder 14 and the plating bath 10 are connected by the pipeline. Therefore, the plating solution F circulates in the plating apparatus 2. Accordingly, the screw 201 and the pipeline function as a solution flowing mechanism.

Figure 4:
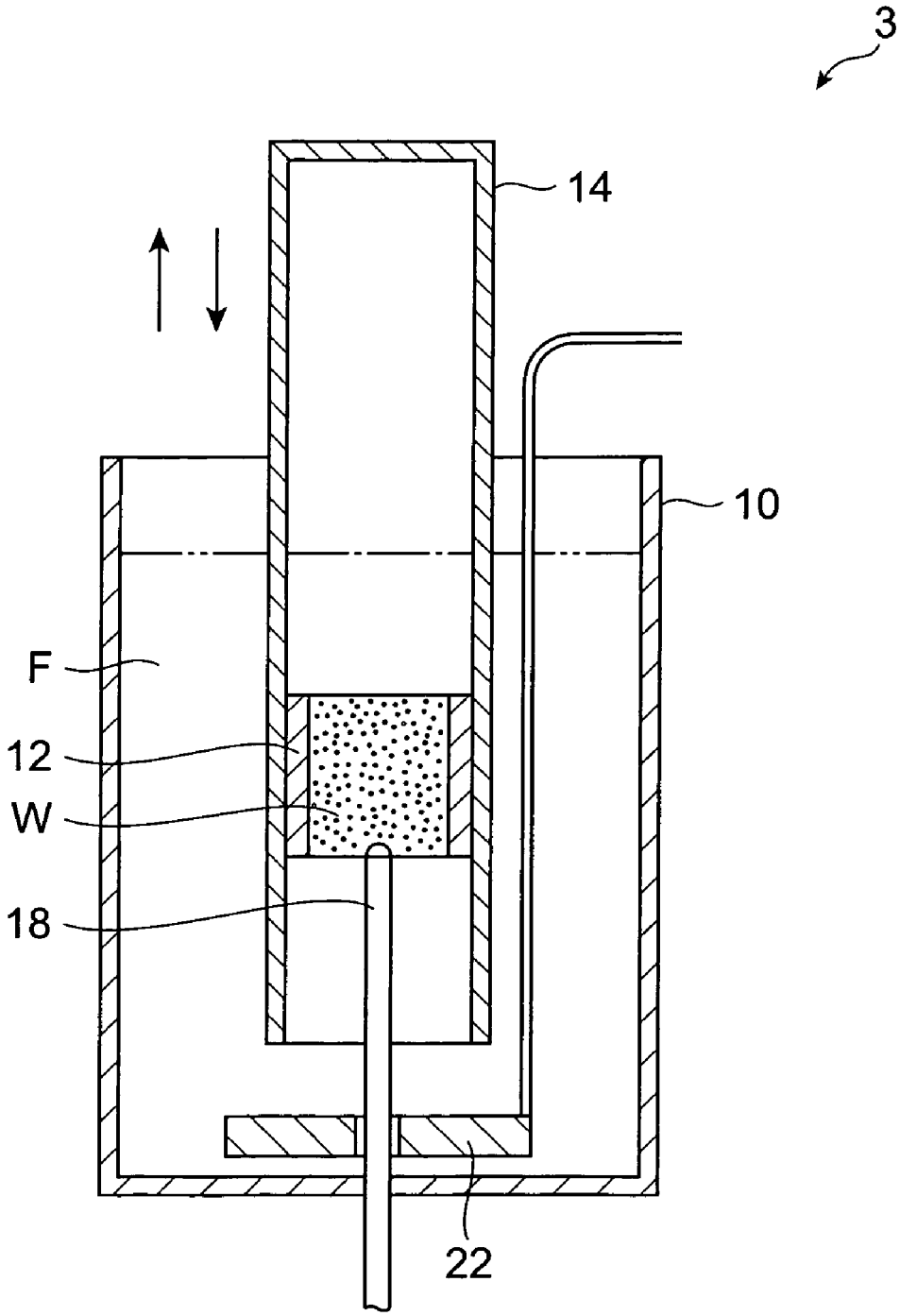
FIG. 4 is a drawing showing a modification example of the plating apparatus shown in FIG. 1.

The plating apparatus 3 according to the second modification example shown in FIG. 4 is provided with a plating bath 10 storing a plating solution F, a pod 12 disposed in the plating bath 10, and a cylinder 14 inside of which the pod 12 is set. An anode 22 is located inside the plating bath 10 and outside the pod 12, and a cathode 18 is located inside the pod 12.

The plating bath 10, pod 12, cathode 18, and anode 22 are the same as those described above. The cylinder 14 is designed to be able to reciprocate up and down in FIG. 4 by means of an unrepresented reciprocating mechanism. The interior of the cylinder 14 is filled with the plating solution F so that the pod 12 can be immersed therein. In accordance with the up-and-down reciprocation of the cylinder 14, the plating solution F in the cylinder 14 flows up and down in FIG. 4. Accordingly, the cylinder 14 and the reciprocating mechanism function as a solution flowing mechanism.

Figure 5:
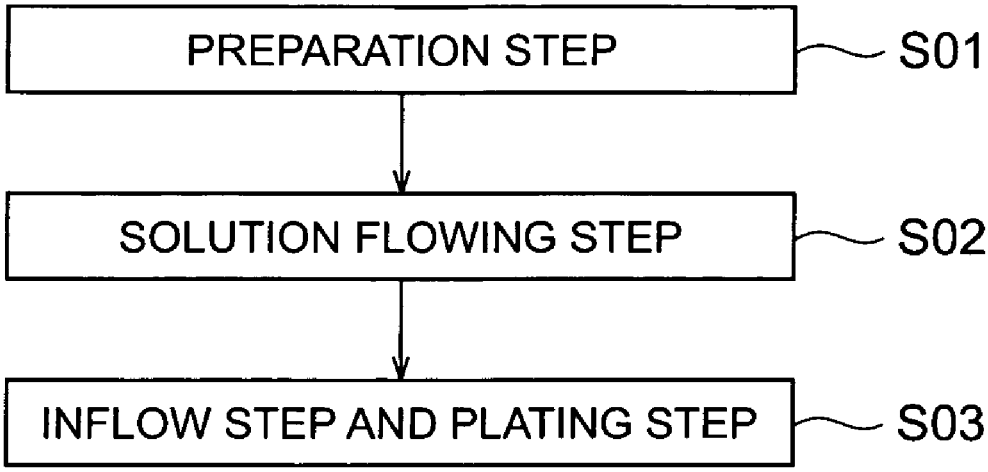
FIG. 5 is a drawing showing a procedure of a plating method using the plating apparatus shown in FIG. 1.

Subsequently, a plating method using the plating apparatus 1-3 will be described, along with the operation of the plating apparatus 1-3. FIG. 5 is a drawing showing a procedure of the plating method. The plating method will be described with reference to FIGS. 1-5 according to need.

The first step is to prepare the pod 12 (cf. FIG. 2) and put works W inside the cylinder 121 of the pod 12. Subsequently, the pod 12 is set inside the cylinder 14, and the cathode 18 and the shaft 20 if necessary are fixed (cf. FIGS. 1, 3, and 4). In a state in which the pod 12 and cylinder 14 are placed in the plating bath 10, the plating bath 10 is filled with the plating solution F (preparation step S01 in FIG. 5).

From the preparation stage at step S01, the plating solution in the cylinder 14 is made to flow (solution flow step S02 in FIG. 5). In the case of the plating apparatus 1 shown in FIG. 1, the second pump P2 is activated to flow the plating solution F inside the cylinder 14 in the upward direction in FIG. 1, thereby lifting the works W up. In the case of the plating apparatus 2 shown in FIG. 3, the screw 201 is rotated forward to flow the plating solution F in the cylinder 14 in the upward direction in FIG. 3, thereby lifting the works W up. In the case of the plating apparatus 3 shown in FIG. 4, the cylinder 14 is moved upward in FIG. 4 to lift the works W up.

Thereafter, the works W lifted up in the pod 12 are moved down. Specifically, in the case of the plating apparatus 1 shown in FIG. 1, the second pump P2 is brought to a halt, and the first pump P1 is activated to flow the plating solution F in the cylinder 14 in the downward direction in FIG. 1, thereby moving the works W down. In the case of the plating apparatus 2 shown in FIG. 3, the screw 201 is rotated backward to flow the plating solution F in the cylinder 14 in the downward direction in FIG. 3, thereby moving the works W down. In the case of the plating apparatus 3 shown in FIG. 4, the cylinder 14 is moved downward in FIG. 4 to move the works W down.

In this manner, the plating solution F flows into the pod 12 and the works W housed therein are moved down to the bottom of the pod 12 to come into contact with the cathode 18. In this state, a predetermined voltage is applied to the cathode 18 and anode 22 to perform the plating process on the works W (inflow step and plating step S03 in FIG. 5). Since the plating process is carried out in the state in which the works W are laid down and piled up as described above, the works W are properly kept in contact with the cathode 18 during the plating process. Therefore, energization efficiency can be improved, so as to increase the plating efficiency. In addition, it is also feasible to prevent a plated film from being formed on the cathode 18.

The present embodiment exemplified the electroplating, but the plating may also be carried out by electroless plating. The present embodiment uses no media (conductive media) in the pod 12, but such media may be put together with the works W in the pod 12 according to need.

Since the present embodiment is designed to flow the plating solution F out of the pod 12 through the mesh 123 located above out of the pair of meshes 123 which the pod 12 in the plating bath 10 has, the substitute plating solution F flows into the pod 12 through the lower mesh 123 in accordance with the outflow. Therefore, the solution flow occurs in the pod 12 and the solution flow lifts the works W up and removes bubbles existing near the works W. Since the plating solution F in the pod 12 is replaced according to the inflow and outflow of the plating solution F, it is feasible to suppress reduction in a metal ion concentration in the pod 12. Since the pair of meshes 123 are provided at the both ends of the cylinder 121 forming the pod 12, it becomes feasible to readily eliminate bubbles in the pod 12 during a work of putting the pod 12 into the plating solution F. Since the plating solution F in the pod 12 can be extracted through the meshes 123 during a work of taking the pod 12 out of the plating solution F, it is feasible to keep small the amount of the plating solution F taken out of the plating bath 10.

Since the works W are lifted up by the solution flow, agitation can be effected without exerting an excessive external force on the works W. Particularly, where a vortex flow is generated in the pod 12 by rotation of the screw 201 or by self-rotation of the pod 12, the works W can be effectively lifted up as agitated.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A plating apparatus for performing a plating process while placing an entity to be plated in a pod disposed in a plating bath storing a plating solution, the plating apparatus comprising:

a cylinder disposed in the plating bath, the pod being disposed in the cylinder;

an anode disposed in the plating bath and outside the pod;

a cathode disposed in the pod; and a solution flowing mechanism for flowing the plating solution in the cylinder;

wherein the pod has at least a pair of sieve members which allow the plating solution to pass but substantially inhibit the entity from passing, and the pod is disposed in the cylinder so that an opposing direction of the pair of sieve members is parallel to a longitudinal direction of the cylinder, and wherein the solution flowing mechanism flows the plating solution inside the pod out of the pod through a first of the pair of sieve members, flows the plating solution outside the pod into the pod through a second of the pair of sieve members, and generates a liquid flow of the plating solution from the second of the pair of sieve members to the first of the pair of sieve members in the cylinder.

2. The plating apparatus according to claim 1, comprising a rotating mechanism for rotating the pod around an axis which is along a direction of outflow of the plating solution.

3. The plating apparatus according to claim 1, wherein the solution flowing mechanism flows the plating solution back into the pod through one of the sieve members through which the plating solution has passed in outflow thereof.

4. The plating apparatus according to claim 1, wherein the pair of sieve members are arranged opposite to each other in a vertical direction.

5. A plating method of performing a plating process while placing an entity to be plated in a pod disposed in a plating bath storing a plating solution, the plating method comprising:

a solution flowing step of disposing the pod in a cylinder, flowing the plating solution inside the pod out of the pod through a first of a pair of sieve members, flowing the plating solution outside the pod into the pod through a second of the pair of sieve members, and generating a liquid flow of the plating solution from the second of the pair of sieve members to the first of the pair of sieve members in the cylinder, and a plating step of letting an electric current pass through the plating solution to plate the entity, wherein an anode is disposed in the plating bath and outside the pod, and a cathode is disposed in the pod.

6. The plating method according to claim 5, further comprising an inflow step of letting the plating solution flow back into the pod through one of the sieve members through which the plating solution has passed in outflow thereof, after the solution flowing step.

7. The plating method according to claim 6, wherein the plating step is carried out in accordance with the inflow step.

* * * * *